US009637963B1

(12) United States Patent
Heichel

(10) Patent No.: US 9,637,963 B1
(45) Date of Patent: May 2, 2017

(54) HINGED CONNECTOR DEVICE

(71) Applicant: Emily Patricia Heichel, Ramsey, MN (US)

(72) Inventor: Emily Patricia Heichel, Ramsey, MN (US)

( * ) Notice: Subject to any disclaimer, the term of this patent is extended or adjusted under 35 U.S.C. 154(b) by 0 days.

(21) Appl. No.: 15/095,492

(22) Filed: Apr. 11, 2016

(51) Int. Cl.
*E05D 5/02* (2006.01)
*E05D 15/06* (2006.01)
*E05D 15/26* (2006.01)
*E05D 7/00* (2006.01)

(52) U.S. Cl.
CPC ..... *E05D 15/26* (2013.01); *E05D 7/00* (2013.01)

(58) Field of Classification Search
CPC . Y10T 16/534; Y10T 16/5345; Y10T 16/544; Y10T 16/5443; Y10T 16/5444; Y10T 16/5445; Y10T 16/5448; E05D 1/04; E05D 2001/045; E05D 3/12; E05D 3/18; E05D 2011/1092; E05D 15/26; E05D 15/30; E05D 7/00; E04B 2001/5868; E04B 2001/5875; E04B 2/7427; E04B 2/7429; E04B 2/7431; F16B 7/04
See application file for complete search history.

(56) References Cited

U.S. PATENT DOCUMENTS 1,962,709 A * 6/1934 Case ..... E05D 1/00 108/119
2,100,928 A * 11/1937 Way ..... E05D 3/186 16/358
2,219,918 A * 10/1940 Economides ..... E05D 1/04 16/260
2,233,882 A * 3/1941 Bobek ..... E05C 17/38 16/348
2,268,669 A * 1/1942 Moore ..... A47F 11/02 16/390
3,781,944 A * 1/1974 Gianardi ..... E05D 5/0215 16/252
4,069,550 A * 1/1978 Silk ..... E05D 3/022 16/361
D267,231 S * 12/1982 Guem, Jr. ..... D21/775
4,670,938 A * 6/1987 Fowlston ..... B65D 43/168 16/225
4,821,382 A * 4/1989 Puschkarski ..... E04B 2/7431 24/298
5,111,802 A * 5/1992 Lin ..... A47J 37/0786 126/25 R
5,259,164 A * 11/1993 Wiese ..... E04B 2/7427 160/135
5,398,376 A * 3/1995 Pollack ..... E05D 1/02 16/225
D372,852 S * 8/1996 Noll ..... D8/328
5,588,181 A * 12/1996 Sutton ..... A47K 3/36 16/252
5,946,774 A * 9/1999 Ramsey ..... E05D 1/04 16/355

(Continued)

*Primary Examiner* — Chuck Mah
(74) *Attorney, Agent, or Firm* — Dave Alan Lingbeck

(57) ABSTRACT

A hinged connector device for hingedly connecting portable wall units together. The hinged connector device includes a first connector assembly including a first engagement member for engaging a first portable wall unit; and a second connector assembly including a second engagement member in pivotable communication with the first engagement member for engaging a second portable wall unit and for connecting the portable wall units together.

13 Claims, 3 Drawing Sheets

(56) References Cited

U.S. PATENT DOCUMENTS

| | | | | | |
|---|---|---|---|---|---|
| 5,971,187 | A * | 10/1999 | Clee | B65D 11/18 | 16/252 |
| 6,292,981 | B1 * | 9/2001 | Ford | E05D 1/04 | 16/357 |
| 7,665,187 | B1 * | 2/2010 | Elowsky | E05D 3/02 | 16/252 |
| 7,886,406 | B2 * | 2/2011 | Chang | E05D 5/08 | 16/252 |
| 8,108,971 | B2 * | 2/2012 | Florek | E05D 1/04 | 16/193 |
| 8,281,459 | B2 * | 10/2012 | Le | E05D 3/022 | 16/350 |
| 8,397,448 | B2 * | 3/2013 | Brown | F24J 2/5205 | 16/252 |
| 8,490,934 | B2 * | 7/2013 | Dittmer | F16M 11/04 | 248/291.1 |
| 8,763,206 | B1 * | 7/2014 | Gong | E05D 1/04 | 16/355 |
| 2011/0024590 | A1 * | 2/2011 | Berger | E05D 5/0246 | 248/222.14 |
| 2011/0084892 | A1 * | 4/2011 | Han | E05D 1/04 | 345/1.3 |
| 2015/0252602 | A1 * | 9/2015 | Nielsen | E05D 11/06 | 16/275 |
| 2016/0083989 | A1 * | 3/2016 | Kuo | E05D 1/04 | 16/355 |

* cited by examiner

HINGED CONNECTOR DEVICE

BACKGROUND OF THE INVENTION

Field of the Invention

The present invention relates to connectors and more particularly pertains to a new hinged connector device for hingedly connecting portable wall units together.

Description of the Prior Art

The use of connectors is known in the prior art. More specifically, connectors heretofore devised and utilized are known to consist basically of familiar, expected and obvious structural configurations, notwithstanding the myriad of designs encompassed by the crowded prior art which have been developed for the fulfillment of countless objectives and requirements.

The prior art includes caps formed of semi-rigid PVC and having opposing channel portions and tapered ends which are integrally connected with an elongate hinge formed of flexible PVC. Also, another prior art includes clip comprising a first jaw for releasable connection to the panel edge, and an opposed, substantially arcuate, second jaw for releasable connection to the rod. Another prior art includes caps slip-fittable onto respective corners of the first and second panels. Further, another prior art includes a first member having a bracket that is shaped to engage an end of a first landscape timber, and a first hinge component. A second member having a bracket that is shaped to receive an end of a second landscape timber, and a second hinge component. Yet, another prior art includes a hinge having two opposing couplers, each having a toothed semicircular portion meshed with the opposing coupler toothed semicircular portion. Each coupler is adapted to be connected to one of the panels to be pivoted with respect to each other. While these devices fulfill their respective, particular objectives and requirements, the aforementioned patents do not disclose a new hinged connector device.

SUMMARY OF THE INVENTION

The general purpose of the present invention, which will be described subsequently in greater detail, is to provide a new hinged connector device which has many of the advantages of the connectors mentioned heretofore and many novel features that result in a new hinged connector device which is not anticipated, rendered obvious, suggested, or even implied by any of the prior art connectors, either alone or in any combination thereof. The present invention includes a first connector assembly including a first engagement member for engaging a first portable wall unit; and a second connector assembly including a second engagement member in pivotable communication with the first engagement member for engaging a second portable wall unit and for connecting the portable wall units together. None of the prior art includes the combination of the elements of the present invention.

There has thus been outlined, rather broadly, the more important features of the hinged connector device in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new hinged connector device which has many of the advantages of the connectors mentioned heretofore and many novel features that result in a new hinged connector device which is not anticipated, rendered obvious, suggested, or even implied by any of the prior art connectors, either alone or in any combination thereof.

Still another object of the present invention is to provide a new hinged connector device for hingedly connecting portable wall units together.

Still yet another object of the present invention is to provide a new hinged connector device that grips the respective wall units and pivots the wall units relative to each other.

Even still another object of the present invention is to provide a new hinged connector device that doesn't twist and stabilizes the wall units at any position relative to one another.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
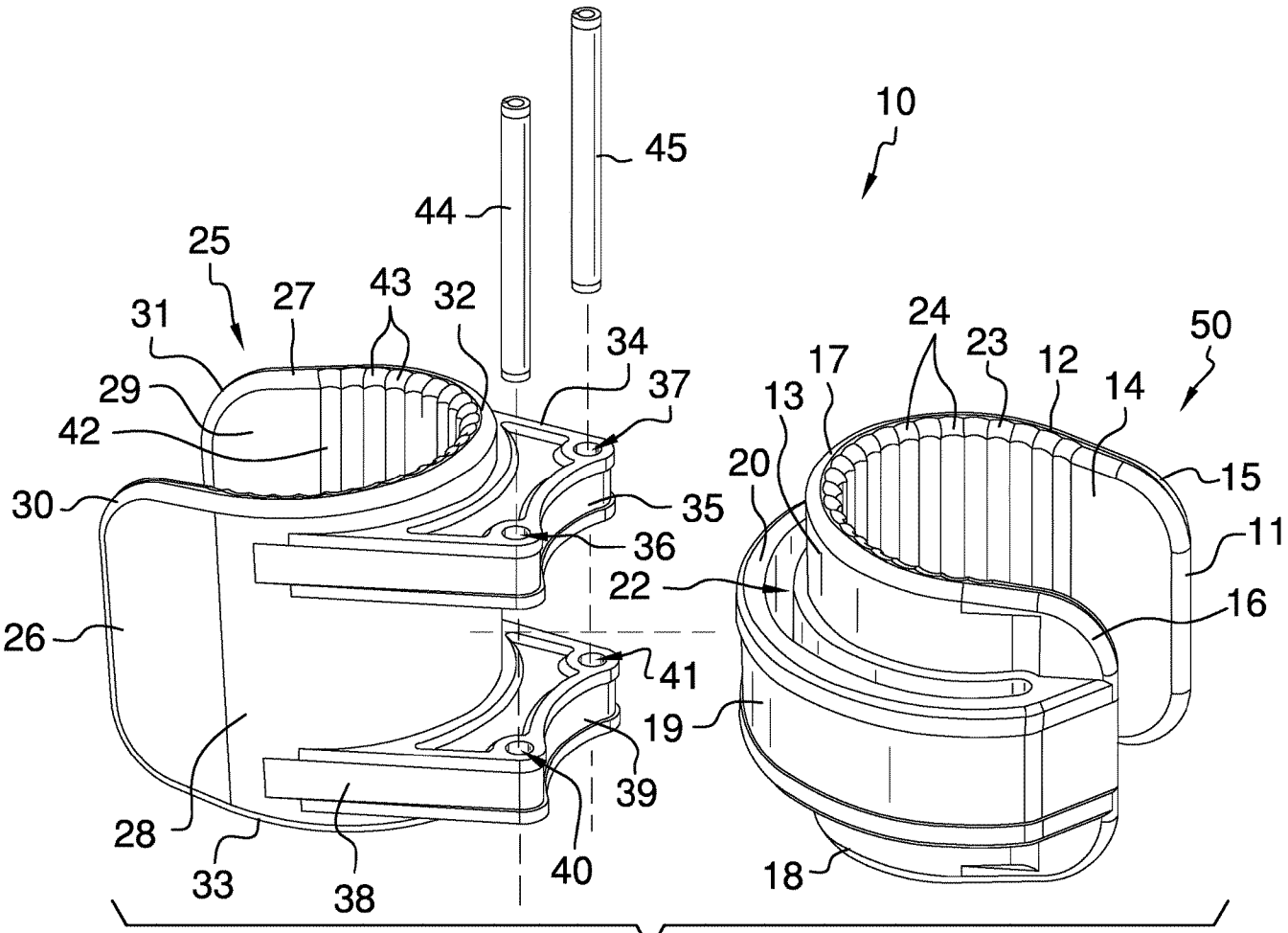
FIG. 1 is an exploded perspective view of a new hinged connector device according to the present invention.
Figure 2:
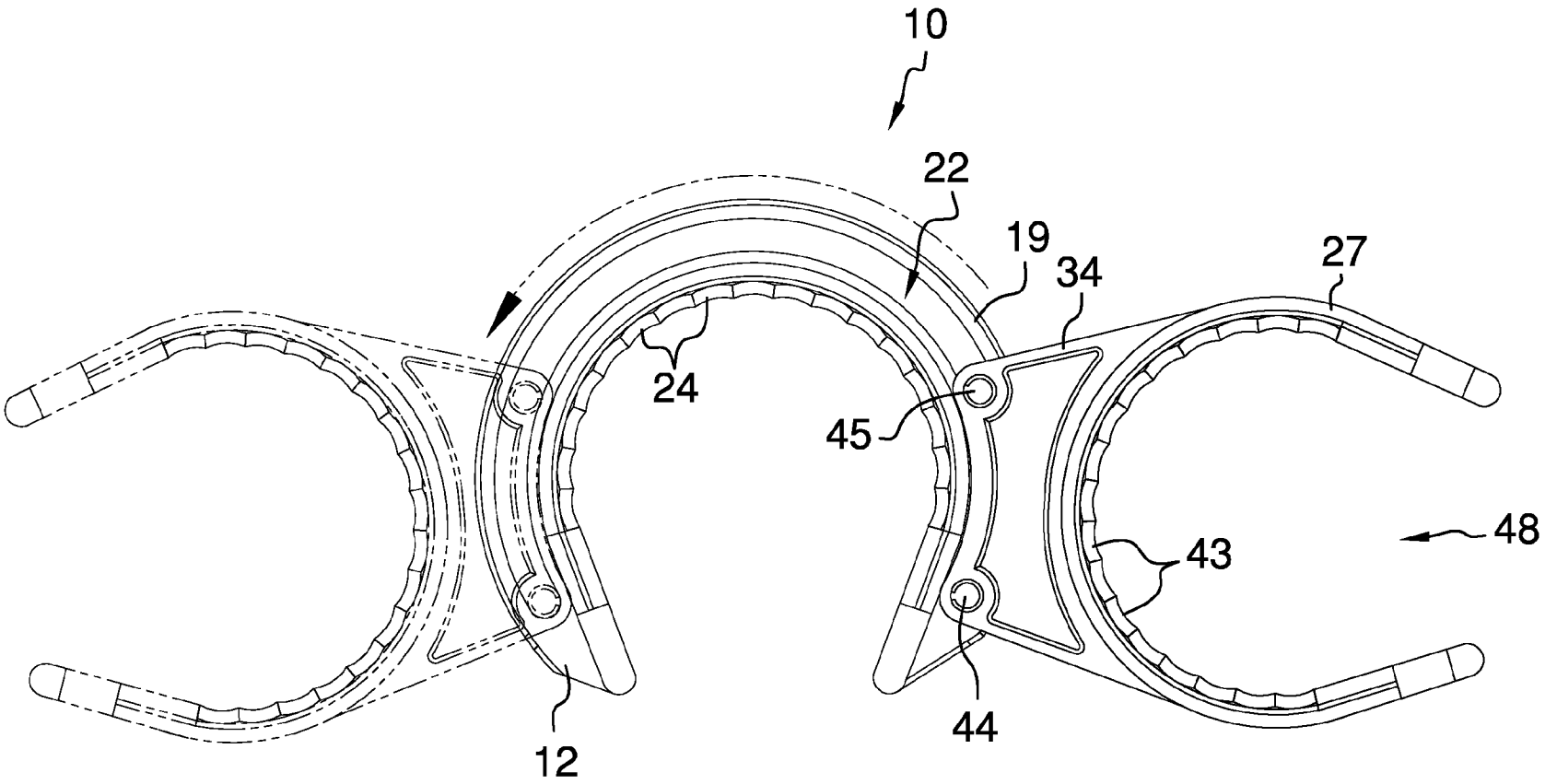
FIG. 2 is a top plan view of the present invention.
Figure 3:
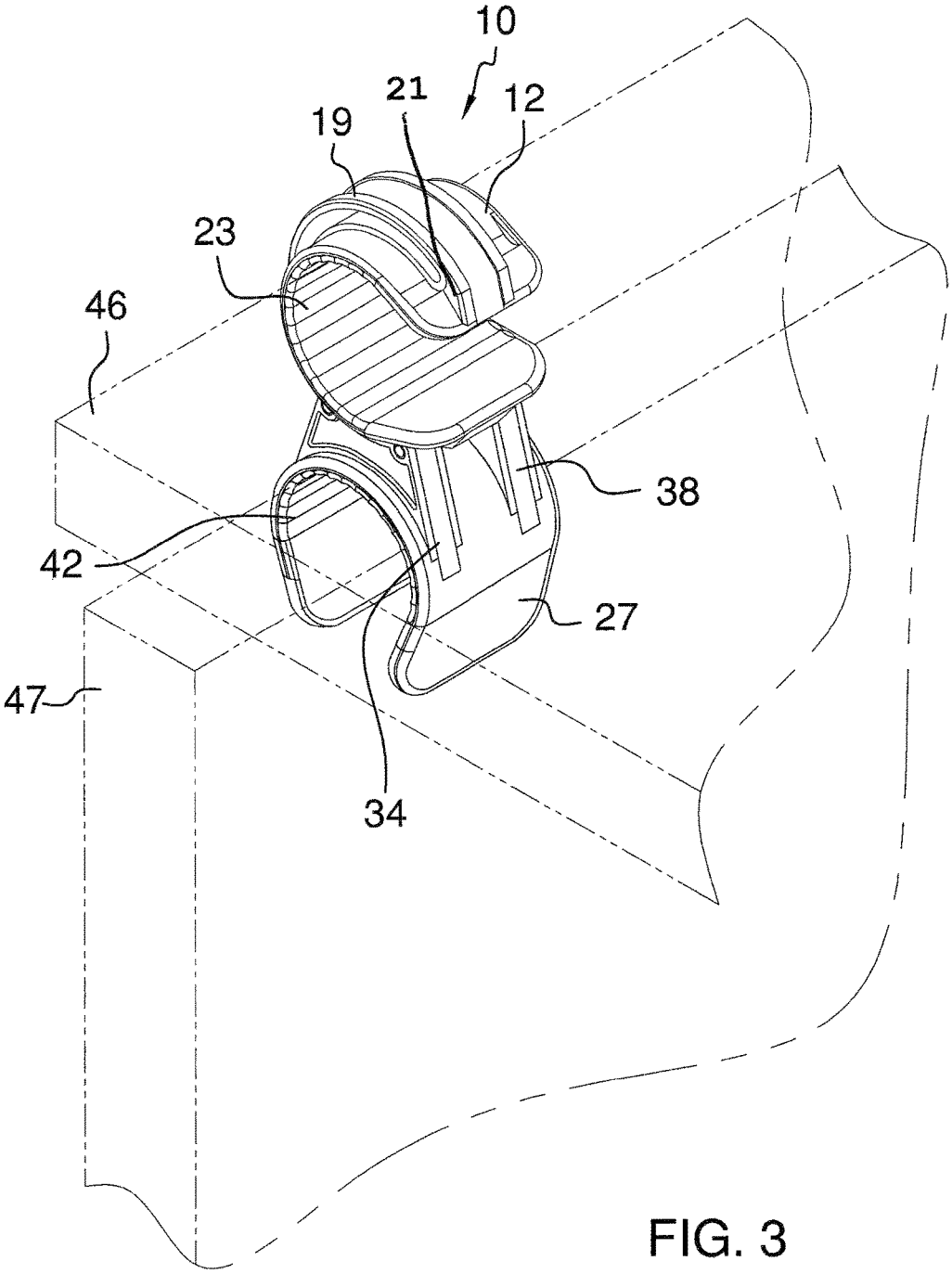
FIG. 3 is a perspective view of the present invention.

With reference now to the drawings, and in particular to FIGS. 1 through 3 thereof, a new hinged connector device embodying the principles and concepts of the present invention and generally designated by the reference numeral 10 will be described.

As best illustrated in FIGS. 1 through 3, the hinged connector device 10 may generally comprise a first connector assembly 50 including a first engagement member 11 for engaging a first portable wall unit 46; and a second connector assembly 25 including a second engagement member 26 in pivotable communication with the first engagement member 11 for engaging a second portable wall unit 47 and for connecting the portable wall units 46, 47 together. The first engagement member 11 may include a first C-shaped member 12 having an inner side 14 and an outer side 13. The first connector assembly 50 may also include a collar 19 conventionally attached to and disposed about the outer side 13 of the first C-shaped member 12. The first C-shaped member 12 may have first and second ends 15, 16 spaced apart for receiving at least a portion of the first portable wall unit 46 therebetween. The collar 19 is C-shaped and conventionally attached or sonic welded to the outer side 13 of the first C-shaped member 12 and extend a width and define the width of the first C-shaped member 12 from the first end 15 to the second end 16. The collar 19 may have a top side 20 and a bottom side 21 with a slot 22 disposed therethrough and extending a length of the collar 19. The first C-shaped member 12 may have a width and opposed edges 17, 18 extending along the length of the first C-shaped member 12 with the collar 19 disposed intermediate of and spaced from the opposed edges 17, 18 to facilitate stability of the first connector assembly 50. The first connector assembly 50 may also include a rigid material 23 with ribs 24 arranged side by side conventionally lining at least a portion of the inner side 14 of the first C-shaped member 12. The ribs 24 may extend axially of the first C-shaped member 12 with the ribs 24 extending from one of the opposed edges 17 to the other of the opposed edges 18 for gripping and engaging the portion of the first portable wall unit 46 removably disposed in the first C-shaped member 12.

As shown in FIGS. 1-3, the second engagement member 26 may include a second C-shaped member 27 having an inner side 29 and an outer side 28. The second C-shaped member 27 may have first and second ends 30, 31 spaced apart which form an opening 48 for receiving a portion of the second portable wall unit 47 therebetween. The second C-shaped member 27 may have a width and opposed edges 32, 33 extending along a length and define the width of the second C-shaped member 27. The second connector assembly 25 may also include brackets 34, 38 conventionally attached to the outer side 28 of the second C-shaped member 27 opposite the opening 48. The brackets 34, 38 may include first and second brackets 34, 38. The first bracket 34 may be conventionally attached or sonic welded near one of the opposed edges 32 of the second C-shaped member 27 and the second bracket 38 may be spaced from the first bracket 34 and conventionally attached and sonic welded near the other of the opposed edges 33 of the second C-shaped member 27. The collar 19 may be movably received between the first and second brackets 34, 38. Each of the first and second brackets 34, 38 may have a distal end 35, 39 spaced from the second C-shaped member 27 and inwardly bowed towards the second C-shaped member 27 to effectively mate with the outer side 13 of the first C-shaped member 12. Each of the first and second brackets 34, 38 may have holes 36, 37, 40, 41 spaced apart and disposed through the distal end 35, 39 of the respective said first and second brackets 34, 38. Each of the holes 36, 37 of the first bracket 34 may be aligned with a respective hole 40, 41 of the second bracket 38. The second connector assembly 25 may further include elongate retainer members 44, 45 removably disposed through the holes 36, 37, 40, 41 of the first and second brackets 34, 38 and through the slot 22 of the collar 19 to pivotably connect the first and second connector assemblies 25, 50 together. The elongate retainer members 44, 45 may be movable along a length of the slot 22 to pivot the first C-shaped member 12 relative to the second C-shaped member 27 and to stabilize and prevent twisting of the C-shaped members 12, 27 relative to one another. The second connector assembly 25 may also include a rigid material 42 with ribs 43 arranged side by side conventionally lining at least a portion of the inner side 29 of the second C-shaped member 27. The ribs 43 may extend axially of the second C-shaped member 27 with the ribs 43 extending from one of the opposed edges 32 to the other of the opposed edges 33 for gripping and engaging the portion of the second portable wall unit 47 removably disposed in the second C-shaped member 27.

In use as illustrated in FIG. 3, the first C-shaped member 12 may be engaged about a portion of the first portable wall unit 46 and the second C-shaped member 27 may be engaged about a portion of the second portable wall unit 47. The first and second portable wall units 46, 47 may be angled and positioned relative to one another by pivoting the connector assemblies 25, 50 relative to one another with the elongate retainer members 44, 45 moving in the slot 22 of the collar 19 and positioned anywhere along the length of the slot 22 to properly position the portable wall units 46, 47.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the hinged connector device. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hinged connector device comprising:

a first connector assembly including a first engagement member for engaging a first portable wall unit, wherein the first engagement member includes a first C-shaped member having an inner side and an outer side, wherein the first connector assembly also includes a collar attached to and disposed about the outer side of the first C-shaped member, wherein the first C-shaped member has first and second ends spaced apart for receiving at least a portion of the first portable wall unit therebetween, wherein the collar is C-shaped and is attached to the outer side of the first C-shaped member and extends a width of the first C-shaped member from the first end to the second end; and a second connector assembly including a second engagement member pivotally connected to the first engagement member for engaging a second portable wall unit and for connecting the portable wall units together.

2. The hinged connector device as described in claim 1, wherein the collar has a top side and a bottom side with a slot disposed therethrough and extending a length of the collar.

3. The hinged connector device as described in claim 2, wherein the second engagement member includes a second C-shaped member having an inner side and an outer side.

4. The hinged connector device as described in claim 3, wherein the second C-shaped member has first and second ends spaced apart which form an opening for receiving a portion of the second portable wall unit therebetween.

5. The hinged connector device as described in claim 4, wherein the second C-shaped member has a width and opposed edges which extend along a length and define the width of the second C-shaped member.

6. The hinged connector device as described in claim 5, wherein the second connector assembly also includes brackets attached to the outer side of the second C-shaped member opposite the opening.

7. The hinged connector device as described in claim 6, wherein the brackets include first and second brackets, wherein the first bracket is attached near one of the opposed edges of the second C-shaped member and the second bracket is spaced from the first bracket and attached near the other of the opposed edges of the second C-shaped member, wherein the collar is movably received between the first and second brackets.

8. The hinged connector device as described in claim 7, wherein each of the first and second brackets has a distal end spaced from the second C-shaped member and inwardly bowed towards the second C-shaped member to effectively mate with the first C-shaped member.

9. The hinged connector device as described in claim 8, wherein each of the first and second brackets has holes spaced apart and disposed through the distal end of the respective said first and second brackets, each of the holes of the first bracket is aligned with a respective said hole of the second bracket.

10. The hinged connector device as described in claim 9, wherein the second connector assembly further includes elongate retainer members removably disposed through the holes of the first and second brackets and through the slot of the collar to pivotably connect the first and second connector assemblies together, wherein the elongate retainer members are movable along a length of the slot to pivot the first C-shaped member relative to the second C-shaped member and to stabilize and prevent twisting of the C-shaped members relative to one another.

11. The hinged connector device as described in claim 3, wherein the second connector assembly also includes a rigid material with ribs arranged side by side lining at least a portion of the inner side of the second C-shaped member.

12. The hinged connector device as described in claim 11, wherein the ribs extend axially of the second C-shaped member with the ribs extending from one of the opposed edges to the other of the opposed edges for gripping and engaging the portion of the second portable wall unit removably disposed in the second C-shaped member.

13. The hinged connector device as described in claim 1, wherein the first C-shaped member has a width and opposed edges extending along the length and define the width of the first C-shaped member with the collar disposed intermediate of and spaced from the opposed edges to facilitate stability of the first connector assembly.

* * * * *